US012752399B2

(12) United States Patent
Chen et al.

(10) Patent No.: US 12,752,399 B2
(45) Date of Patent: Oct. 6, 2026

(54) COMPOSITE ABRASIVE PAPER

(71) Applicant: Shaoxing Ziyuan Polishing Co., Ltd., Shaoxing (CN)

(72) Inventors: Senjun Chen, Shaoxing (CN); Cuilan Ba, Shaoxing (CN); Jin Zhang, Shaoxing (CN); Xia Jiang, Shaoxing (CN); Jimin Li, Shaoxing (CN)

(73) Assignee: Shaoxing Ziyuan Polishing Co., Ltd., Shaoxing (CN)

( * ) Notice: Subject to any disclaimer, the term of this patent is extended or adjusted under 35 U.S.C. 154(b) by 461 days.

(21) Appl. No.: 18/106,538

(22) Filed: Feb. 7, 2023

(65) Prior Publication Data

US 2024/0261937 A1 Aug. 8, 2024

(51) Int. Cl.
*B24D 11/04* (2006.01)
*B24D 11/02* (2006.01)

(52) U.S. Cl.
CPC ..... *B24D 11/04* (2013.01); *B24D 11/02* (2013.01)

(58) Field of Classification Search
CPC ..... B24D 15/04; B24D 11/02; B24D 11/04
USPC ..... 451/533
See application file for complete search history.

(56) References Cited

U.S. PATENT DOCUMENTS 449,930 A * 4/1891 Dubey ..... B24D 11/00 451/529
3,014,233 A * 12/1961 Gibbons ..... A47L 13/03 53/553
3,431,689 A * 3/1969 Schnabel ..... B24D 15/04 451/532
3,777,444 A * 12/1973 Dunn ..... B24D 15/04 451/523
3,977,452 A * 8/1976 Wright ..... A45C 11/24 383/105
4,674,237 A * 6/1987 Sullivan ..... B32B 27/36 451/523
5,573,453 A * 11/1996 Tiefenbach, Jr. ..... B24D 3/28 451/533
5,712,210 A * 1/1998 Windisch ..... D04H 1/64 451/535
5,918,341 A * 7/1999 Hale ..... A47L 13/16 451/526
2004/0038634 A1* 2/2004 McCarthy ..... B24D 15/04 451/526

(Continued)

*Primary Examiner* — Brian D Keller
*Assistant Examiner* — Marcel T Dion
(74) *Attorney, Agent, or Firm* — JEEN IP LAW, LLC

(57) ABSTRACT

A composite abrasive paper has at least three surfaces which polished and ground to improve the utilization rate of the abrasive paper and reduce the cost of grinding and polishing abrasive tools. The abrasive paper comprises a first abrasive comprising a first substrate, a first stereo particle layer provided on a surface of the first substrate, a flexible microsphere layer provided on a back surface of the first substrate; a second abrasive comprising a second substrate, a second stereo particle layer provided on surface of the second substrate, a third stereo particle layer provided on a back surface of the first substrate; the first and second abrasive are connected at an edge to form a connection part, the middle non-connection part of the first substrate and the second substrate forms a sealed cavity, the third stereo particle layer is provided opposite to the flexible microsphere layer in the sealed cavity.

1 Claim, 1 Drawing Sheet

(56) References Cited

U.S. PATENT DOCUMENTS

| | | | | |
|---|---|---|---|---|
| 2007/0066185 | A1* | 3/2007 | Felipe, Sr. | B24B 7/20 451/41 |
| 2007/0144074 | A1* | 6/2007 | Petersen | B24D 11/02 51/307 |
| 2016/0177152 | A1* | 6/2016 | Braun | B01J 2/20 51/307 |
| 2018/0153355 | A1* | 6/2018 | Avshalom | A47K 7/03 |
| 2019/0016936 | A1* | 1/2019 | Bauer | C01F 7/442 |
| 2019/0084114 | A1* | 3/2019 | Corrigan | B24B 13/012 |
| 2023/0018097 | A1* | 1/2023 | Conboy | B32B 29/02 |

* cited by examiner

COMPOSITE ABRASIVE PAPER

TECHNICAL FIELD

The present invention relates to an abrasive consumable and, more particularly, to a composite abrasive paper.

BACKGROUND

In many production processes, it is necessary to carry out grinding and polishing on the blank part or finished product of the product. There are many kinds of grinding and polishing mills, and abrasive paper is the most common abrasive tool.

3M Company first introduced an abrasive having a three-dimensional structure (e.g. patents U.S. Pat. Nos. 5,851,247, 7,410,413B2, 7,887,607B2, 8,348,723B2, WO 2007/035252, WO 00/64630), and obtained a three-dimensional structure abrasive by a three-dimensional design and a micro-repeated coating of the abrasive. The three-dimensional structure abrasive overcomes the disadvantages of the above-mentioned conventional coated abrasives, and has advantages of a strong chip removal capacity, a long grinding life, and a high grinding precision.

However, since the abrasive paper is a consumable, after the three-dimensional surface of the abrasive paper loses the property of grinding and polishing due to consumption, the abrasive paper can only be discarded; in addition, such three-dimensional abrasives generally have only one three-dimensional structure on the surface, and the suitable abrasive scene is relatively limited.

SUMMARY

It is an object of the present invention to provide a composite abrasive paper, wherein a single composite abrasive paper has at least three surfaces which can be polished and ground to increase the usage rate of the abrasive paper and reduce the cost of grinding and polishing abrasive tools in the production process, and thus has broader commercial application value.

A composite abrasive paper, comprising:

- a first abrasive comprising a first substrate, a first three-dimensional particle layer provided on a surface of the first substrate, and a flexible microsphere layer provided on a back surface of the first substrate;
- a second abrasive comprising a second substrate, a second three-dimensional particle layer provided on a surface of the second substrate, and a third three-dimensional particle layer provided on a back surface of the first substrate;
- the first abrasive and the second abrasive are connected at an edge to form a connection part, and the middle non-connection part of the first substrate and the second substrate forms a sealed cavity, and the third three-dimensional particle layer is provided opposite to the flexible microsphere layer in the sealed cavity.

By adopting the above-mentioned technical solution, a piece of composite abrasive paper is provided with multiple surfaces which can be ground/polished, the loss speed is reduced, and the use cost of consumables for customers is reduced, so that the product has a very high commercial application value; in addition, the flexible microsphere layer prevents the third three-dimensional particle layer from being forced against the first substrate in the sealed cavity during the grinding/polishing operation of the first abrasive.

Preferably, the particle shapes of the first three-dimensional particle layer, the second three-dimensional particle layer and the third three-dimensional particle layer are geometric bodies having a determined shape, the geometric shape of each three-dimensional particle layer is the same, and there are at least two different particle shapes in the three three-dimensional particle layers.

By using the above-mentioned technical solution, a piece of composite abrasive paper has various forms of surfaces for grinding/polishing, so that more grinding/polishing scenes can be applied and the applicability can be improved.

Preferably, the particle shape is any one of a cone, a pyramid, a sphere, a triangular prism, a cube, a cylinder, and a multi-cube.

By using the above-mentioned technical solution, production and manufacturing are facilitated and suitable for common grinding/polishing demand scenarios.

Preferably, the connection part is provided with a dashed cavity with a dashed tear line formed by a plurality of discontinuity cuts.

By using the above-mentioned technical solution, after both the inner and outer surfaces of the composite abrasive paper are worn seriously, a new grinding/polishing surface needs to be replaced, and then the third three-dimensional particle layer can be exposed only by tearing from the dashed tear line, and used for grinding/polishing again, and the composite abrasive paper is used to the maximum extent.

11. a first substrate; 12. a flexible microsphere layer; 13. a first three-dimensional particle layer; 21. a second substrate; 22. a third three-dimensional particle layer; 23. a second three-dimensional particle layer; 3. a sealed cavity; 4. a connection part; 41. a dashed tear line.

DETAILED DESCRIPTION

Figure 1:
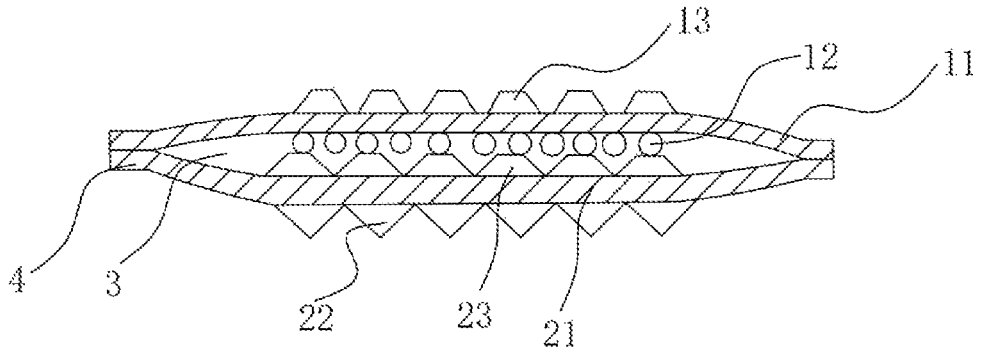
FIG. 1 is a schematic cross-sectional view of a composite abrasive paper of the present invention.
Figure 2:
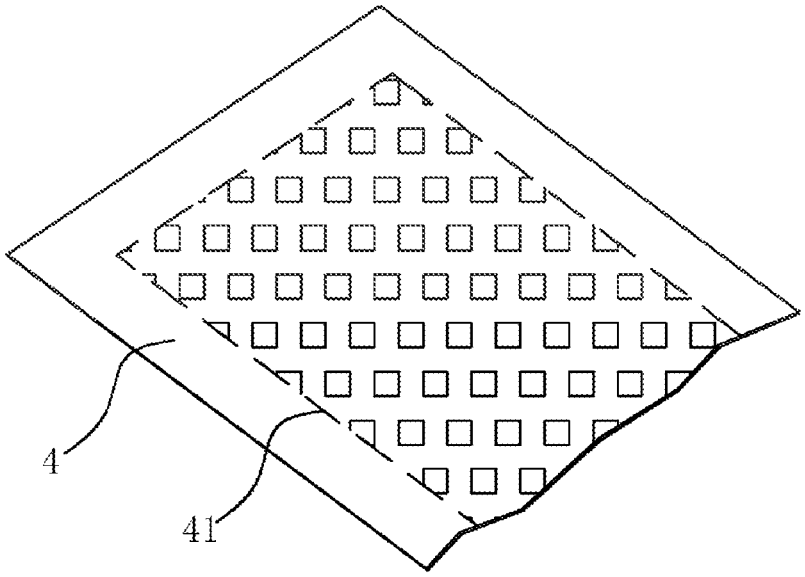
FIG. 2 is a schematic illustration of a partial break of a composite abrasive paper of the present invention.

The invention will now be further described with reference to FIGS. 1-2.

Example 1

A composite abrasive paper comprising:

- a first abrasive comprising a first substrate 11, a first three-dimensional particle layer 13 provided on the surface of the first substrate 11, and a flexible microsphere layer 12 provided on a back surface of the first substrate 11;
- a second abrasive comprising a second substrate 21, a second three-dimensional particle layer 23 provided on the surface of the second substrate 21, and a third three-dimensional particle layer 22 provided on the back surface of the first substrate 11;
- wherein the particle shapes of the first three-dimensional particle layer 13, the second three-dimensional particle layer 23 and the third three-dimensional particle layer 22 are geometric bodies having a determined shape, the geometric shape of each three-dimensional particle layer is the same, there are at least two different particle shapes in the three three-dimensional particle layers, and the specific particle shape can be any one of a cone, a pyramid, a sphere, a triangular prism, a cube, a cylinder and a multi-cube;

the first abrasive and the second abrasive are connected at the edge to form a connection part 4, and a sealed cavity 3 is formed at the position 4 of the middle non-connection part of the first substrate 11 and the second substrate 21, and the third three-dimensional particle layer 22 and the flexible microsphere layer 12 are oppositely provided in the sealed cavity 3; the connection part 4 is provided adjacent to the sealed cavity 3 with a dashed tear line 41 formed by a plurality of discontinuity cuts.

Example II

A composite abrasive paper, comprising:

a first abrasive comprising a first substrate 11, a first three-dimensional particle layer 13 provided on the surface of the first substrate 11, and a flexible microsphere layer 12 provided on a back surface of the first substrate 11;

a second abrasive comprising a second substrate 21, a second three-dimensional particle layer 23 provided on the surface of the second substrate 21, and a third three-dimensional particle layer 22 provided on the back surface of the first substrate 11;

wherein the particle shapes of the first three-dimensional particle layer 13, the second three-dimensional particle layer 23 and the third three-dimensional particle layer 22 are geometric bodies having a determined shape, the geometric shape of each three-dimensional particle layer is the same, and the particle shapes of the three three-dimensional particle layers are also the same, and the particle shape is any one of a cone, a pyramid, a sphere, a triangular prism, a cube, a cylinder and a multi-cube;

the first abrasive and the second abrasive are connected at an edge to constitute a connection part 4, and the middle non-connection part 4 of the first substrate 11 and the second substrate 21 forms a sealed cavity 3, and the third three-dimensional particle layer 22 is provided opposite to the flexible microsphere layer 12 in the sealed cavity 3.

When it is desired to use the third solid particle layer 22 for grinding/polishing, it is only necessary to use scissors to cut short from the junction 4 and the sealed cavity 3.

It should be noted herein that the flexible microsphere layer 12 of the present invention can be made of the "flexible microsphere product with high temperature stability" described by 3M Innovation Co. Ltd. in the patent number CN201510329205.9.

Both the first substrate 11 and the second substrate 21 can be made of materials commonly used on the market.

The above-mentioned embodiments are merely preferred embodiments of the present invention, and are not intended to limit the scope of the present invention, and any insubstantial changes and substitutions made by a person skilled in the art on the basis of the present invention fall within the scope of the present invention as claimed.

What is claimed is:

1. A composite abrasive paper, comprising:

a first abrasive comprising a first substrate, a first three-dimensional particle layer fixedly bonded to a surface of the first substrate, and a flexible microsphere layer fixedly bonded to a back surface of the first substrate;

a second abrasive comprising a second substrate, a second three-dimensional particle layer fixedly bonded to a surface of the second substrate, and a third three-dimensional particle layer fixedly bonded to a back surface of the second substrate;

wherein the first abrasive and the second abrasive are connected at an edge to form a connection part, and a middle of the first substrate and the second substrate forms a sealed cavity, and the second three-dimensional particle layer is provided opposite to the flexible microsphere layer in the sealed cavity;

particles within each of the first three-dimensional particle layer, the second three-dimensional particle layer, and the third three-dimensional particle layer have the same shape, while the shapes of the particles in the first, second, and third three-dimensional particle layers are different from each other;

the shape of particles within each of the first, second, and third three-dimensional particle layers is selected from a group consisting of a cone, a pyramid, a sphere, a triangular prism, a cube, a cylinder, and a multi-cube, different particle shapes providing different grinding effects;

a dashed tear line formed by a plurality of discontinuous cuts is provided at a junction of the connection part and the sealed cavity, which makes the junction easy to tear, such that after tearing along the dashed tear line, the flexible microsphere layer and the second three-dimensional particle layer originally sealed in the sealed cavity can be flipped outwardly and exposed as additional abrasive surfaces, each having a grinding characteristic different from that of the first and third three-dimensional particle layers.

* * * * *